US011105553B2

(12) United States Patent
Victory et al.

(10) Patent No.: US 11,105,553 B2
(45) Date of Patent: Aug. 31, 2021

(54) METHOD AND SYSTEM FOR LNG PRODUCTION USING STANDARDIZED MULTI-SHAFT GAS TURBINES, COMPRESSORS AND REFRIGERANT SYSTEMS

(71) Applicants: Donald J. Victory, Sugar Land, TX (US); Sorin T. Lupascu, Spring, TX (US); Kary E. Saleeby, Houston, TX (US); O. Angus Sites, Spring, TX (US)

(72) Inventors: Donald J. Victory, Sugar Land, TX (US); Sorin T. Lupascu, Spring, TX (US); Kary E. Saleeby, Houston, TX (US); O. Angus Sites, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 229 days.

(21) Appl. No.: 16/005,167

(22) Filed: Jun. 11, 2018

(65) Prior Publication Data

US 2019/0063825 A1 Feb. 28, 2019

Related U.S. Application Data

(60) Provisional application No. 62/549,463, filed on Aug. 24, 2017.

(51) Int. Cl.
*F25J 1/02* (2006.01)
*F25J 1/00* (2006.01)

(52) U.S. Cl.
CPC ..... *F25J 1/029* (2013.01); *F25J 1/0022* (2013.01); *F25J 1/0052* (2013.01); *F25J 1/0055* (2013.01);
(Continued)

(58) Field of Classification Search
CPC F25J 1/029; F25J 1/0294; F25J 1/0087; F25J 1/0256; F25J 1/0236; F25J 1/0022;
(Continued)

(56) References Cited

U.S. PATENT DOCUMENTS 5,689,141 A 11/1997 Kikkawa et al. ..... 290/52
6,053,007 A * 4/2000 Victory ..... F25J 3/0209 62/619

(Continued)

FOREIGN PATENT DOCUMENTS

EP 2426452 3/2012 ..... F25J 1/02
WO WO2017/067871 4/2017 ..... F01D 15/10

OTHER PUBLICATIONS

GE Frame 9E Gas Turbine—Used Gas Turbine for Sale (Year: 2018).*

(Continued)

*Primary Examiner* — Nelson J Nieves
(74) *Attorney, Agent, or Firm* — ExxonMobil Upstream Research Comoany—Law Department

(57) ABSTRACT

A drive system for liquefied natural gas (LNG) production. A standardized machinery string consisting of a multi-shaft gas turbine with no more than three compressor bodies, where the compressor bodies are applied to one or more refrigerant compressors employed in one or more refrigerant cycles (e.g., single mixed refrigerant, propane precooled mixed refrigerant, dual mixed refrigerant). The standardized machinery strings and associated standardized refrigerators are designed for a generic range of feed gas composition and ambient temperature conditions and are installed in opportunistic liquefaction plants without substantial reengineering and modifications. The approach captures D1BM ("Design
(Continued)

1 Build Many) cost and schedule efficiencies by allowing for broader variability in liquefaction efficiency with location and feed gas composition.

15 Claims, 8 Drawing Sheets

(52) U.S. Cl.
CPC ..... *F25J 1/0087* (2013.01); *F25J 1/0212* (2013.01); *F25J 1/0214* (2013.01); *F25J 1/0216* (2013.01); *F25J 1/0236* (2013.01); *F25J 1/0256* (2013.01); *F25J 1/0283* (2013.01); *F25J 1/0292* (2013.01); *F25J 1/0294* (2013.01); *F25J 1/0296* (2013.01); *F25J 2230/20* (2013.01); *F25J 2230/22* (2013.01); *F25J 2280/10* (2013.01); *F25J 2290/42* (2013.01)

(58) Field of Classification Search
CPC ..... F25J 1/0052; F25J 1/0055; F25J 1/0292; F25J 1/0296; F25J 1/0214; F25J 1/0212; F25J 1/0216; F25J 1/0283; F25J 2230/20; F25J 2230/22; F25J 2280/10; F25J 2290/42
See application file for complete search history.

(56) References Cited

U.S. PATENT DOCUMENTS 6,308,531 B1* 10/2001 Roberts ..... F25J 1/0022 62/611
6,324,867 B1 12/2001 Fanning et al. ..... 62/613
6,691,531 B1* 2/2004 Martinez ..... F25J 1/0289 62/612
2003/0121268 A1* 7/2003 Erickson ..... F02C 3/305 60/775
2007/0193303 A1 8/2007 Hawrysz et al. ..... 62/612
2008/0134718 A1* 6/2008 Howard ..... F25J 3/04024 62/643
2009/0054191 A1* 2/2009 Holt ..... F04D 25/022 475/59
2009/0249829 A1* 10/2009 Lourenco ..... C10L 3/10 62/632
2010/0058801 A1* 3/2010 Masani ..... F01D 15/005 62/611
2010/0293967 A1* 11/2010 Liskow ..... F01D 15/005 62/6
2010/0326133 A1* 12/2010 Beeby ..... F25J 1/0249 62/614
2011/0120184 A1* 5/2011 Seeley ..... B01D 53/14 62/636
2011/0239699 A1* 10/2011 Kolscheid ..... F01D 15/08 62/611
2011/0252827 A1* 10/2011 Lockwood ..... B01D 53/002 62/602
2013/0074511 A1* 3/2013 Tanaeva ..... F01D 15/005 60/772
2013/0145794 A1* 6/2013 Rasmussen ..... F02C 6/04 62/611
2013/0312457 A1* 11/2013 Zick ..... F25J 3/0209 62/620
2015/0300735 A1* 10/2015 Valencia ..... F25J 3/0209 62/637
2018/0066889 A1* 3/2018 Gaskin ..... F25J 3/0295

OTHER PUBLICATIONS

GE LMS100—Aeroderivative Gas Turbine Turbine Technics (Year: 2006).*
LMS100 Baker Hughes, a GE Company (Year: 2006).*
Ims100-fact-sheet-product-specifications (Year: 2006).*
U.S. Appl. No. 62/375,700, filed Aug. 16, 2016, Matheidas, Michael T. et al.
U.S. Appl. No. 62/506,922, filed May 16, 2017, Guy, Ashley R. et al.

* cited by examiner

METHOD AND SYSTEM FOR LNG PRODUCTION USING STANDARDIZED MULTI-SHAFT GAS TURBINES, COMPRESSORS AND REFRIGERANT SYSTEMS

CROSS REFERENCE TO RELATED APPLICATIONS

This application claims the priority benefit of U.S. Patent Application No. 62/549,463 filed Aug. 24, 2017 entitled METHOD AND SYSTEM FOR LNG PRODUCTION USING STANDARDIZED MULTI-SHAFT GAS TURBINES, COMPRESSORS AND REFRIGERANT SYSTEMS, the entirety of which is incorporated by reference herein.

FIELD

The present techniques provide methods and systems for producing liquefied natural gas (LNG). More specifically, the present techniques provide for methods and systems to produce LNG using large-scale multi-shaft gas turbines.

BACKGROUND

This section is intended to introduce various aspects of the art, which can be associated with exemplary examples of the present techniques. This description is believed to assist in providing a framework to facilitate a better understanding of particular aspects of the present techniques. Accordingly, it should be understood that this section should be read in this light, and not necessarily as admissions of prior art.

Liquefied natural gas (LNG) is produced by cooling natural gas using processes that generally require refrigeration compressors and compressor drivers. Liquefying natural gas enables monetization of natural gas resources, and the meeting of energy demands, in areas where pipeline transport of natural gas is cost prohibitive. In a typical LNG refrigeration configuration, illustrated in FIG. 1, a common drive shaft 102 connects a gas turbine 104 to one end of a compressor 106. The common drive shaft 102 also connects a starter motor 108 to the other end of the compressor 106. The three connected devices are typically referred to as a compression string 100. Multiple collocated compression strings and the associated refrigeration and liquefaction heat exchangers may be referred to as an LNG train.

Global LNG competition has intensified, with potential growth from new projects in development currently being forecast to outstrip new firm demand. To enhance the profitability of future LNG projects there is a need to identify and optimize the key cost drivers and efficiencies applicable to each project.

When a large scale resource is available, developing it with a small number of large capacity LNG trains can provide environmental benefits (such as minimizing the overall footprint of the constructed facilities) and economic benefits (such as accelerating the production profiles). Further, minimizing the number of compression strings installed in each LNG train can provide an avenue to reduce the capital cost required to develop the resource.

FIG. 2 is a schematic diagram of an exemplary LNG train 200 having first, second, and third compression strings 202, 204, 206 according to known principles. Each compression string includes a single shaft 212, 214, 216 and is driven by a single-shaft gas turbine 222, 224, 226, which in some cases may be a GE Frame 9E single-shaft gas turbine. Each compression string also includes one or more refrigeration compressors 232, 234, 235, 236. Each compression string further includes a large-scale variable frequency drive (VFD) 242, 244, 246 and a motor/generator 252, 254, 256. Such an LNG train may have a nominal LNG production capacity of 8 MTA. It has been observed that the compression power required by different strings operating in the same train is generally different, likely resulting in a gas turbine power use imbalance when the compression strings are driven by identical gas turbines. This creates an opportunity to export excess gas turbine power from one compression string to the plant electric power grid and to reallocate some or all of this excess power to supplement power driving one or more of the other compressor strings.

FIG. 3 depicts another known type of compression string 300, in which an electric starter/helper motor/generator 302 with drive-through capability is positioned between a turbine 304 and a compressor 306 on a common drive shaft 308, and a variable frequency drive (VFD) 310 electrically connected between the electric starter/helper motor/generator 302 and an electrical power grid 312. The VFD 310 conditions the AC frequency both from the electrical power grid 312 for smoother startup and nonsynchronous helper duty as well as to the electrical power grid, such that mechanical power can be converted to electrical power by the electric starter/helper motor/generator 302 and supplied to the electrical power grid at the grid frequency. This allows the speed of the turbine 304 to be dictated by throughput needs. This compression string 300, as disclosed by Rasmussen, enables LNG train configurations with single shaft gas turbines, such as LNG train 200, to maximize capacity by shifting excess gas turbine power to power limited compressor strings, and maximize fuel efficiency by operating all gas turbines at or near peak load. When used in an LNG train, compression string 300 permits nonsynchronous operation with each individual compression string and the electrical grid potentially at different operating speeds and frequencies, and for efficient gas turbine operation with speed control, thereby providing for LNG throughput control, compressor operating point optimization, and greater resilience to process upsets compared to known synchronous LNG train operation with single-shaft turbines at fixed speeds, as disclosed, for example, in U.S. Pat. No. 5,689,141 by Kikkawa.

Aeroderivatives are smaller scale multi-shaft turbines that do not require a large electrical motor for starting the compression strings, providing some cost benefits by eliminating the large electrical motors, variable frequency drives, and power generation capacity required by large scale single-shaft gas turbines. A larger number of aeroderivatives is required than large scale industrial turbines in order to achieve similar LNG train capacities due to the lower power output of the aeroderivative units, potentially increasing the overall cost of a large scale development. On the other hand, new multi-shaft gas turbine options are becoming available, including fuel efficient large scale multi-shaft industrial turbines such as the GE LMS100, the Mitsubishi Hitachi H110 and the Siemens SGT5-2000E turbines, and some of these large multi-shaft gas turbines operate at lower speeds compared to smaller turbines, thereby permitting more aerodynamically efficient large compressors that may be used in LNG service. What is therefore needed is an LNG compression string design and/or LNG train design that uses new turbine technology to support large-scale LNG production. What is also needed is such a large-scale LNG compression string design and/or LNG train design with a reduced amount of components contained therein.

Historically development of mid scale (e.g. 0.5-2.0 MTA) and large scale (≥2.0 MTA) LNG projects has involved extended periods of custom engineering and design optimization in order to match the specific natural gas resource, site ambient conditions and target output with the selected refrigerant compressor drivers and liquefaction technology. Prospective LNG projects competing for the lowest cost of supply in the current market environment stand to benefit from standardized, repeatable designs that offer means to simultaneously reduce both the capital expenditure and the time duration required from investment decision to delivery.

At first glance, the selection of standardized designs without substantial optimization may appear to compromise efficiency and create uncertainty around the actual expected LNG throughput at the selected site. Multi-shaft gas turbines with free power turbines and wide variable speed range offer the means to adjust compressor operating points and maximize efficiency of the one or more refrigeration compressors and consequently the efficiency of the LNG production trains. Conversely engineering rating calculations and simulation models offer the means to expediently determine the expect site performance and capacity based on gas composition and ambient parameters.

SUMMARY

The disclosed aspects provide a drive system for liquefied natural gas (LNG) refrigeration compressors in a LNG production train. A standardized single compression string consists of a multi-shaft gas turbine with an output shaft operating a speed below 4,000 rpm, and no more than three standardized compressor bodies, each of the compressor bodies being applied to one or more refrigeration compressors employed in one or more refrigerant cycles. The standardized single compression string is designed for a generic range of feed gas composition, ambient temperature and other site conditions.

The disclosed aspects also provide a method of producing liquefied natural gas (LNG). An LNG production train is formed by matching the standardized single compression string of paragraph 1 to a standardized refrigerant heat exchanger system and to a standardized heat rejection system. LNG is produced using the standardized single compression string. The standardized refrigerant heat exchanger system and standardized heat rejection system are designed for a generic range of feed gas composition, ambient temperature and other site conditions and are installed in opportunistic locations and facilities without substantial reengineering and modifications.

DESCRIPTION OF THE DRAWINGS

The advantages of the present techniques are better understood by referring to the following detailed description and the attached drawings, in which.

DETAILED DESCRIPTION

Figure 1:
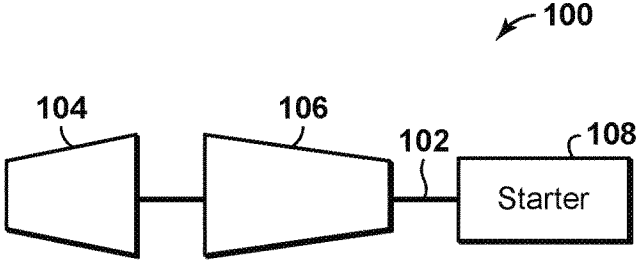
FIG. 1 (Prior Art)
FIG. 1 is a schematic diagram of an LNG compression string according to known principles.
Figure 3:
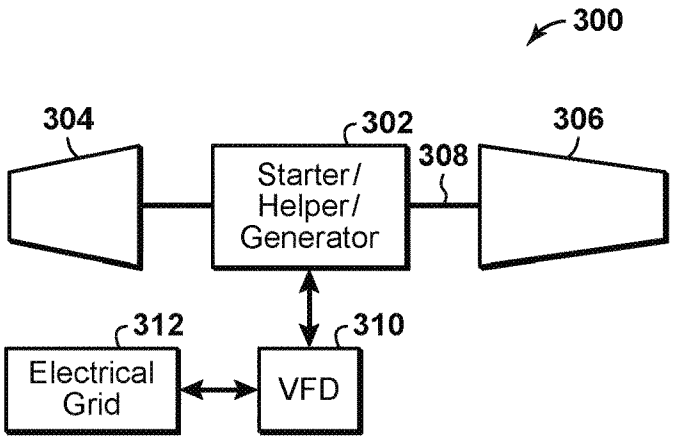
FIG. 3 (Prior Art)
FIG. 3 is a schematic diagram of an LNG compression string according to known principles.
Figure 2:
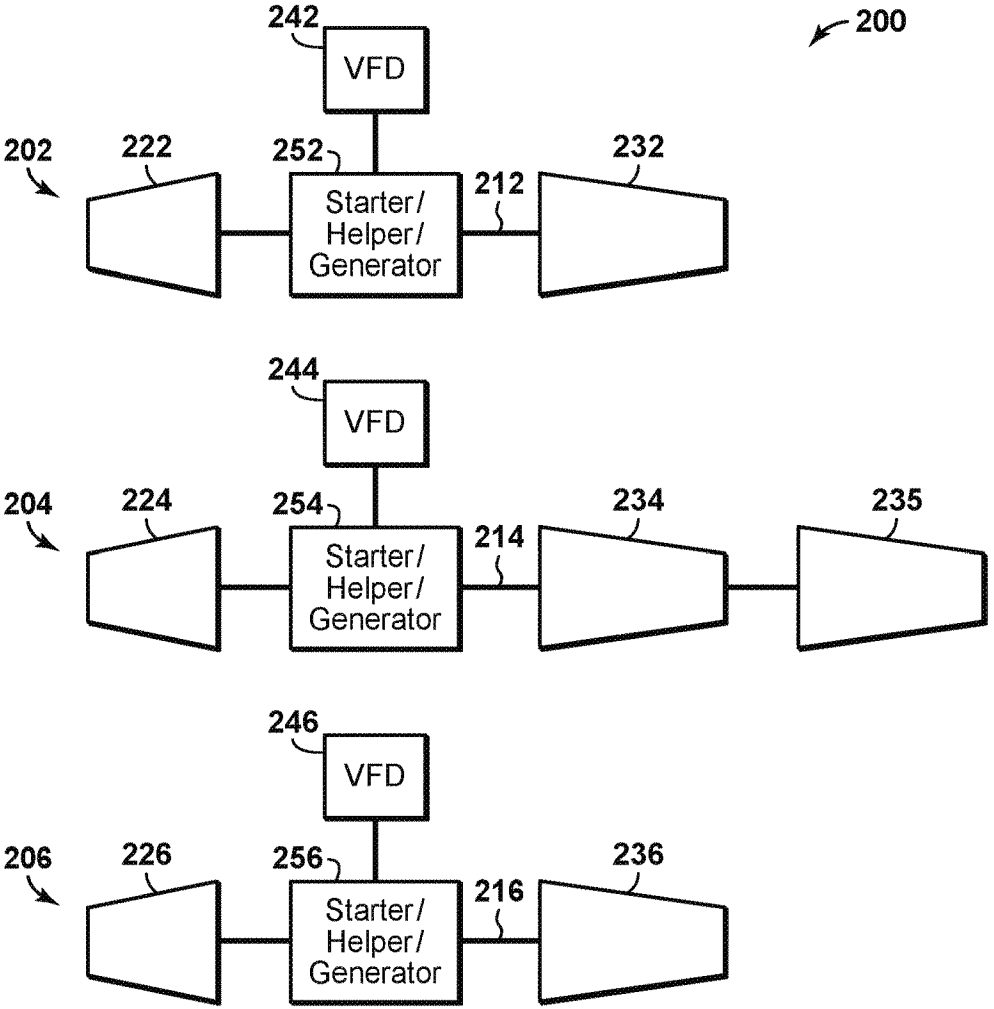
FIG. 2 (Prior Art)
FIG. 2 is a schematic diagram of an LNG train according to known principles.

In the following detailed description section, non-limiting examples of the present techniques are described. However, to the extent that the following description is specific to a particular example or a particular use of the present techniques, this is intended to be for exemplary purposes only and simply provides a description of the exemplary examples. Accordingly, the techniques are not limited to the specific examples described below, but rather, include all alternatives, modifications, and equivalents falling within the true spirit and scope of the appended claims.

At the outset, for ease of reference, certain terms used in this application and their meanings as used in this context are set forth. Further, the present techniques are not limited by the usage of the terms shown below, as all equivalents, synonyms, new developments, and terms or techniques that serve the same or a similar purpose are considered to be within the scope of the present claims.

As one of ordinary skill would appreciate, different persons may refer to the same feature or component by different names. This document does not intend to distinguish between components or features that differ in name only. The figures are not necessarily to scale. Certain features and components herein may be shown exaggerated in scale or in schematic form and some details of conventional elements may not be shown in the interest of clarity and conciseness. When referring to the figures described herein, the same reference numerals may be referenced in multiple figures for the sake of simplicity. In the following description and in the claims, the terms "including" and "comprising" are used in an open-ended fashion, and thus, should be interpreted to mean "including, but not limited to."

The articles "the," "a" and "an" are not necessarily limited to mean only one, but rather are inclusive and open ended so as to include, optionally, multiple such elements.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numeral ranges provided. Accordingly, these terms should be interpreted as indicating that insubstantial or inconsequential modifications or alterations of the subject matter described and are considered to be within the scope of the disclosure.

"Exemplary" is used exclusively herein to mean "serving as an example, instance, or illustration." Any embodiment or aspect described herein as "exemplary" is not to be construed as preferred or advantageous over other embodiments.

The term "gas" is used interchangeably with "vapor," and is defined as a substance or mixture of substances in the gaseous state as distinguished from the liquid or solid state. Likewise, the term "liquid" means a substance or mixture of substances in the liquid state as distinguished from the gas or solid state.

A "hydrocarbon" is an organic compound that primarily includes the elements hydrogen and carbon, although nitrogen, sulfur, oxygen, metals, or any number of other elements can be present in small amounts. As used herein, hydrocarbons generally refer to components found in natural gas, oil, or chemical processing facilities.

"Natural gas" refers to a multi-component gas obtained from a crude oil well or from a subterranean gas-bearing formation. The composition and pressure of natural gas can vary significantly. A typical natural gas stream contains methane ($CH_4$) as a major component, i.e., greater than 50 mol % of the natural gas stream is methane. The natural gas stream can also contain ethane ($C_2H_6$), heavy hydrocarbons (e.g., $C_3$-$C_{20}$ hydrocarbons), one or more acid gases (e.g., $CO_2$ or $H_2S$), or any combinations thereof. The natural gas can also contain minor amounts of contaminants such as water, nitrogen, iron sulfide, wax, crude oil, or any combinations thereof. The natural gas stream can be substantially purified, so as to remove compounds that may act as poisons.

"Liquefied Natural Gas" or "LNG" refers to is natural gas that has been processed to remove one or inure components (for instance, helium) or impurities (for instance, water and/or heavy hydrocarbons) and then condensed into a liquid at almost atmospheric pressure by cooling.

A "Large Scale" gas turbine is a gas turbine having a rated output capacity of at least 40 megawatts (MW), or at least 50 MW, or at least 70 MW, or at least 80 MW, or at least 100 MW.

A "mixed refrigerant" is refrigerant formed from a mixture of two or more components selected from the group comprising: nitrogen, methane, ethane, ethylene, propane, propylene, butanes, pentanes, etc. A mixed refrigerant or a mixed refrigerant stream as referred to herein comprises at least 5 mol % of two different components. A common composition for a mixed refrigerant can be: Nitrogen 0-10 mol %; Methane ($C_1$) 30-70 mol %; Ethane ($C_2$) 30-70 mol %; Propane ($C_3$) 0-30 mol %; Butanes ($C_4$) 0-15 mol %. The total composition comprises 100 mol %.

"Substantial" when used in reference to a quantity or amount of a material, or a specific characteristic thereof, refers to an amount that is sufficient to provide an effect that the material or characteristic was intended to provide. The exact degree of deviation allowable may depend, in some cases, on the specific context.

"Non-synchronous" refers to rotational speeds that are not always aligned with local electrical grid frequency (which may be 50 Hz (3,000 rpm), 60 Hz (3,600 rpm), or another frequency) but fall within a commonly accepted operating range around the local frequency. Such operating range depends on the design of the turbine and may be ±3%, or ±5%, or ±10%, or ±20%, or more than ±20% of the local frequency.

The present techniques provide a drive system for liquefied natural gas (LNG) refrigeration compressors in a LNG production train. The drive system includes a standardized single turbo machinery string consisting of a multi-shaft gas turbine with no more than two standardized compressor bodies, no reducing gear box, and an optional starter motor having a power rating of less than 5 megawatts (MW). The multi-shaft gas turbine operates at a speed below 3,700 RPM and ideally approximately 3,000 RPM. The compressor bodies are applied to one or more refrigerant compressors employed in one or more refrigerant cycles, such as single mixed refrigerant, propane precooled mixed refrigerant, and/or dual mixed refrigerant. The standardized single turbo machinery string is designed for a generic range of feed gas composition, ambient temperature and other site conditions and is installed in opportunistic locations and facilities without substantial reengineering or modifications to capture D1BM ("Design 1 Build Many") cost and schedule efficiencies by allowing for broader variability in liquefaction efficiency with location and feed gas composition.

Figure 4A:
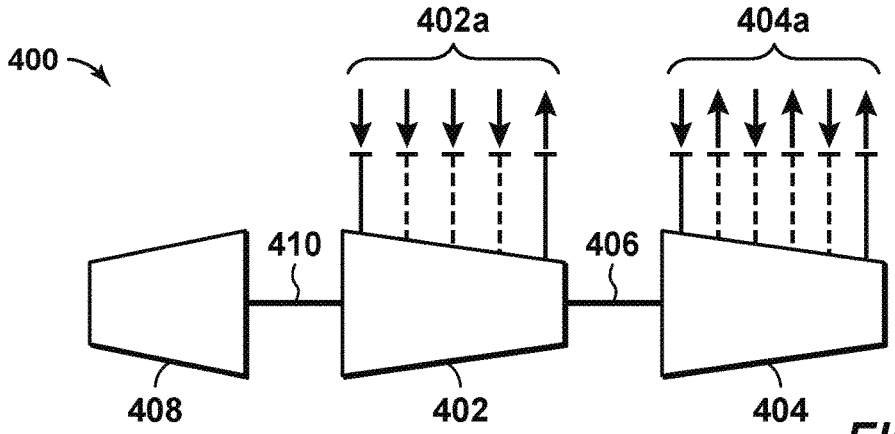
FIGS. 4A-4D are schematic diagrams of LNG compression strings and gas turbines according to disclosed aspects.

FIG. 4A is a schematic diagram of an LNG compression string 400 that may comprise an LNG train according to disclosed aspects. LNG compression string may be termed a propane pre-cooled mixed refrigerant driver system. LNG compression string 400 includes one or more refrigeration compressors, depicted here as first and second refrigeration compressors 402, 404. Each of the first and second refrigeration compressors includes inlets and outlets 402*a*, 404*a* for permitting fluid to be compressed to enter and exit the respective compressor. The first and second refrigeration compressors are connected to a first shaft 406, which may also be considered a coupling. The compression string includes a large scale multi-shaft gas turbine 408 that is connected to a second shaft 410 (which may also be considered a coupling), thereby providing a driving force to the first and second refrigeration compressors 402, 404. In an aspect, the large scale multi-shaft gas turbine 408 may comprise, as non-limiting examples, the GE LMS100 turbine, the Mitsubishi Hitachi H110 turbine, or any other large-scale multi-shaft gas turbine. In an aspect, the large scale multi-shaft gas turbine 408 may be capable of providing an actual transmitted power output of between 40 MW and 90 MW, or between 50 MW and 80 MW, or between 60 MW and 70 MW, or greater than 70 MW. Because the large scale multi-shaft gas turbines can take advantage of their inherent wider turndown range than single-shaft gas turbines, LNG train production and efficiency may be improved and even maximized. For example, the inherent turn-down range of the large scale multi-shaft gas turbines may be used to start the compressors from rest, bring the compressors up to an operating rotational speed, and adjust the compressor operating points to maximize efficiency of the compressors, all without assistance from electrical motors with drive-through capability or variable frequency drives. The use of large scale fuel-efficient multi-shaft gas turbines in a configuration as shown in FIG. 4 may allow for LNG train capacities in excess of approximately 1.0 million tons per year (MTA), or between 1.0 MTA and 1.2 MTA, or between 1.2 MTA and 1.5 MTA, or between 1.5 MTA and 1.7 MTA, or greater than 1.7 MTA, with a single LNG compressor string. Additional LNG compression strings, substantially identical in design and construction, may be run parallel to LNG compression string 400 to increase a capacity of a liquefaction installation. It may be desired to include a relatively small starter/helper motor rated at less than 1 MW, or less than 3 MW, or less than 5 MW, or less than 7 MW. The elimination of these components (including the removal or downsizing of some electrical power generation equipment otherwise required to drive the starter/helper motors) provides significant capital cost savings as well as operating savings.

In aspect, first refrigeration compressor 402 may be used to provide compression for a propane refrigerant, and in a preferred aspect, the first refrigeration compressor may employ a horizontal split casing. Second refrigeration compressor string 404 may be used to provide compression for a mixed refrigerant, and in a preferred aspect, the second refrigeration compressor may employ a vertical split casing, although a horizontal split casing may be employed instead.

Figure 4B:
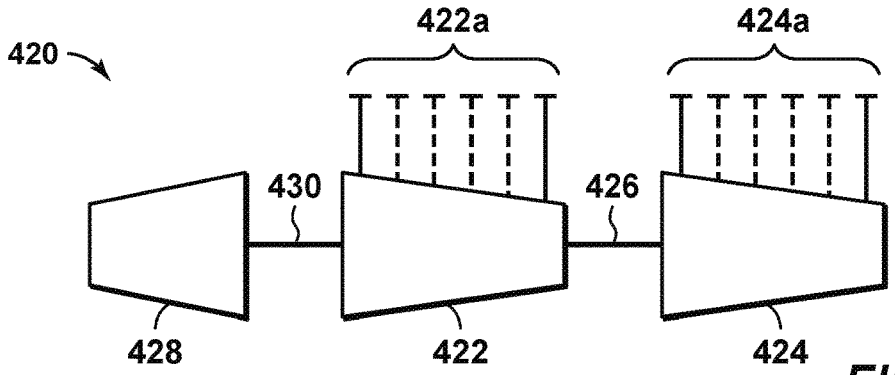

FIG. 4B is a schematic diagram of an LNG compression string 420 that may comprise an LNG train according to disclosed aspects. LNG compression string may be termed a dual mixed-refrigerant driver system. Like LNG compression string 400, LNG compression string 420 includes one or more refrigeration compressors, depicted here as first and second refrigeration compressors 422, 424. Each of the first and second refrigeration compressors includes inlets and outlets 422*a*, 424*a* for permitting fluid to be compressed to enter and exit the respective compressor. The first and second refrigeration compressors are connected to a first shaft 426, which may also be considered a coupling. The compression string includes a large scale multi-shaft gas turbine 423 that is connected to a second shaft 430 (which may also be considered a coupling), thereby providing a driving force to the first and second refrigeration compressors 422, 424. The large scale it gas turbine 423 is similar to large multi-shaft gas turbine 408 and for the sake of brevity is not further described. In an aspect, first refrigeration compressor 422 may be used to provide compression for a first mixed refrigerant, and in a preferred aspect, the first refrigeration compressor may employ a vertical split casing, although a horizontal split casing may be employed. Second refrigeration compressor string 424 may be used to provide compression for a second mixed refrigerant, and in a preferred aspect, the second refrigeration compressor may employ a horizontal split casing, although a vertical split casing may be employed instead.

Figure 4C:
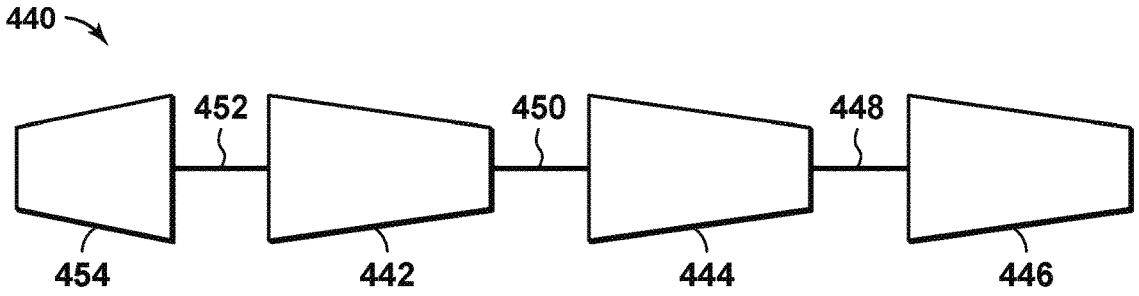

Aspects of the disclosure are not limited to employing a large scale multi-shaft gas turbine to drive two refrigeration compressors. FIG. 4C shows an LNG compression string 440 according to an aspect of the disclosure in which first, second, and third refrigeration compressors 442, 444, 446 are connected through first, second, and third shafts or couplings 448, 450, 452 to a large scale multi-shaft gas turbine 454. Each of the first, second, and third refrigeration compressors 442, 444, 446 may provide compression to a propane refrigerant, a mixed refrigerant, or other refrigerant types. Each of the refrigeration compressors may use a horizontal or vertical split casing as desired.

Figure 4D:
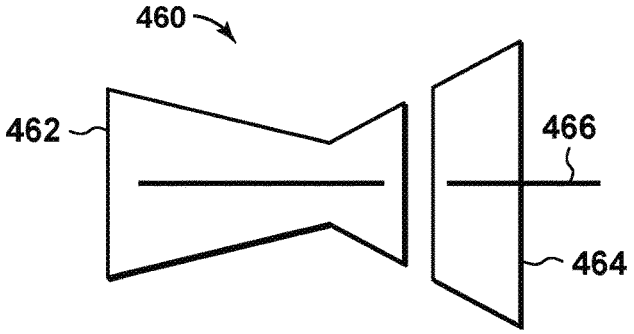

FIG. 4D illustrates a gas turbine 460 which may be preferably used in aspects of the disclosure. Gas turbine 460 includes a gas generator 462 and a free power turbine 464. The free power turbine 464 typically includes a shaft 466 that is not mechanically connected to the gas generator 462 but is rotated by expansion of the hot pressurized gases produced by the gas generator 462. The shaft 466 is configured to be connected to one or more refrigeration compressors as previously disclosed. Other suitable known gas turbine designs may be used with aspects of the disclosure as desired.

Figure 5A:
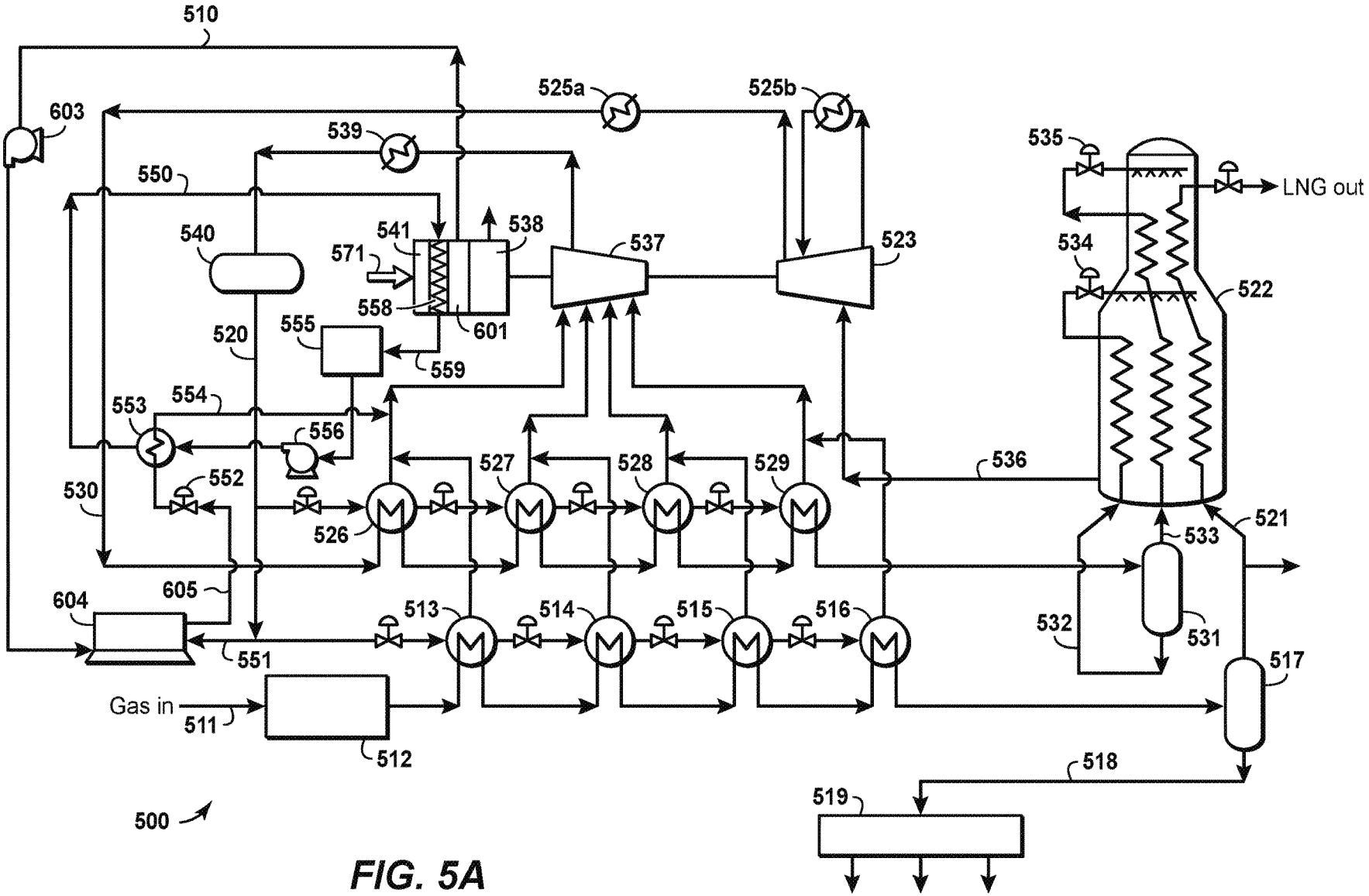
FIGS. 5A-5B are schematic diagrams of systems for liquefying natural gas according to disclosed aspects.
Figure 6:
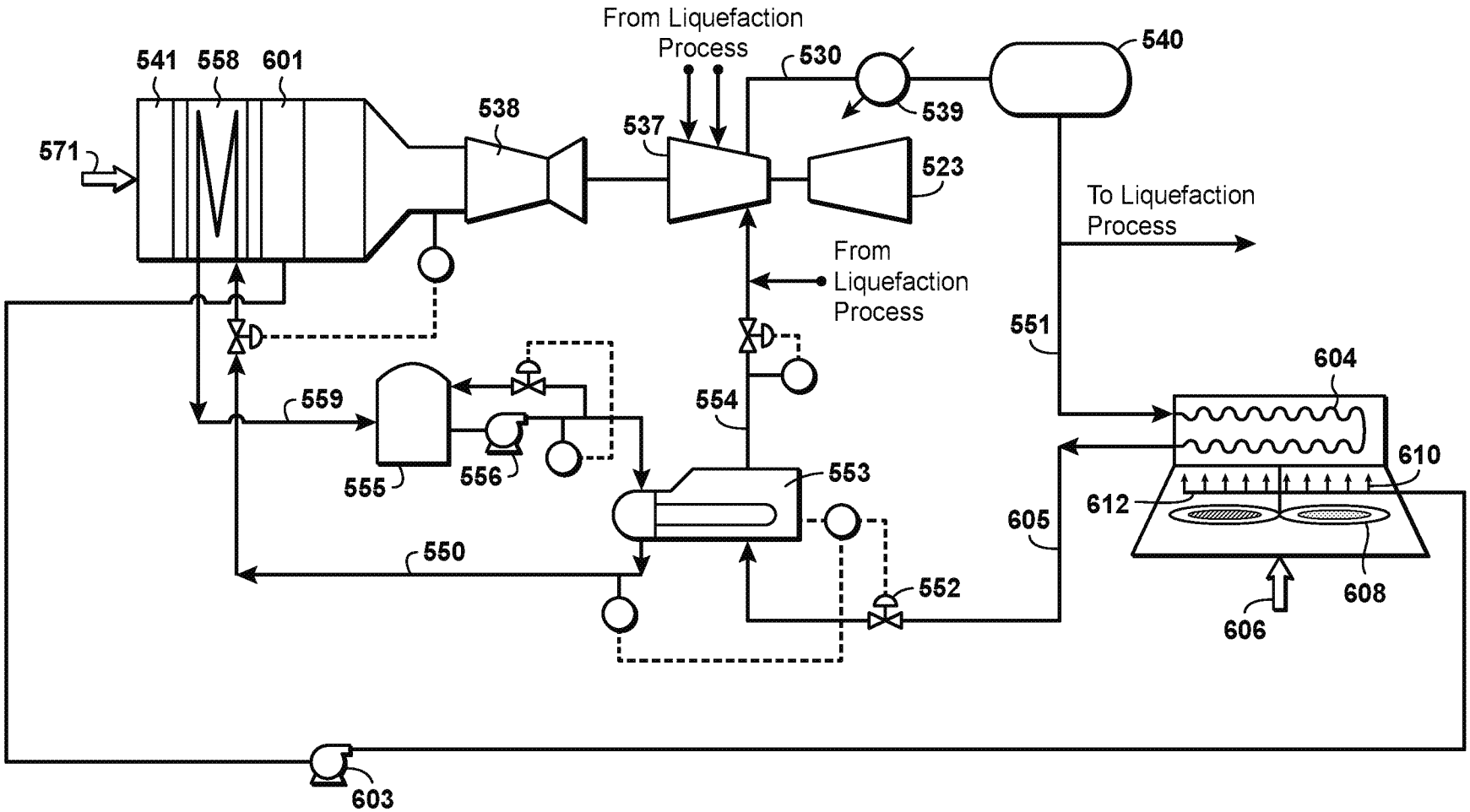
FIG. 6 is a schematic diagram of part of the system shown in FIG. 5A.

FIGS. 5A and 6 illustrate a system 500 and process for liquefying natural gas (LNG) according to aspects of the disclosure. Similar systems are further described in commonly owned U.S. Provisional Patent Application No. 62/506,922 filed May 16, 2017, U.S. Patent Application No. 62/375,700 filed Aug. 16, 2016, and in U.S. Pat. No. 6,324,867, the disclosures of which are incorporated by reference herein in their entirety. It is to be understood that system 500 is merely one example of how the disclosed aspects may be employed, and that the disclosed aspects may be used in any LNG liquefaction system requiring multiple refrigeration compressors. In system 500, feed gas (natural gas) enters through an inlet line 511 into a preparation unit 512 where it is treated to remove contaminants. The treated gas then passes from preparation unit 512 through a series of heat exchangers 513, 514, 515, 516, where it is cooled by evaporating the first refrigerant (e.g. propane) which, in turn, is flowing through the respective heat exchangers through a first refrigeration circuit 520. The cooled natural gas then flows to fractionation column 517 wherein pentanes and heavier hydrocarbons are removed through line 518 for further processing in a fractionating unit 519.

The remaining mixture of methane, ethane, propane, and butane is removed from fractionation column 517 through line 521 and is liquefied in the main cryogenic heat exchanger 522 by further cooling the gas mixture with a second refrigerant that may comprise a mixed refrigerant (MR) which flows through a second refrigerant circuit 530. The second refrigerant, which may include at least one of nitrogen, methane, ethane, and propane, is compressed in a second refrigeration compressor 523 which, in turn, are driven by a gas turbine 538. After compression, the second refrigerant is cooled by passing through air or water coolers 525*a*, 525*b* and is then partly condensed within heat exchangers 526, 527, 528, and 529 by evaporating the first refrigerant from first refrigerant circuit 520. The second refrigerant may then flow to a high pressure separator 531, which separates the condensed liquid portion of the second refrigerant from the vapor portion of the second refrigerant. The condensed liquid and vapor portions of the second refrigerant are output from the high pressure separator 531 in lines 532 and 533, respectively. As seen in FIG. 5, both the condensed liquid and vapor from high pressure separator 531 flow through main cryogenic heat exchanger 522 where they are cooled by evaporating the second refrigerant.

The condensed liquid stream in line 532 is removed from the middle of main cryogenic heat exchanger 522 and the pressure thereof is reduced across an expansion valve 534. The now low pressure second refrigerant is then put back into the main cryogenic heat exchanger 522 where it is evaporated by the warmer second refrigerant streams and the feed gas stream in line 521. When the second refrigerant vapor stream reaches the top of the main cryogenic heat exchanger 522, it has condensed and is removed and expanded across an expansion valve 535 before it is returned to the main cryogenic heat exchanger 522. As the condensed second refrigerant vapor falls within the main cryogenic heat exchanger 522, it is evaporated by exchanging heat with the feed gas in line 521 and the high pressure second refrigerant stream in line 532. The falling condensed second refrigerant vapor mixes with the low pressure second refrigerant liquid stream within the middle of the main cryogenic heat exchanger 522 and the combined stream exits the bottom of the main cryogenic heat exchanger 522 as a vapor through outlet 536 to flew back to second refrigeration compressor 523, to complete second refrigerant circuit 530.

The closed first refrigeration circuit 520 is used to cool both the feed gas and the second refrigerant before they pass through main cryogenic heat exchanger 522. The first refrigerant is compressed by a first refrigeration compressor 537 which, in turn, is powered by gas turbine 538. In an aspect, an additional refrigerant compressor and gas turbine (not shown), arranged in parallel with the first refrigeration compressor 537 and the gas turbine 538, may be used to compress the first refrigerant, it being understood that reference to the first refrigeration compressor 537 and the gas turbine 538 herein also refer to said additional refrigerant compressor and gas turbine. The first refrigeration compressor 537 may comprise at least one compressor casing and the at least one casing may collectively comprise at least two inlets to receive at least two first refrigerant streams at different pressure levels. The compressed first refrigerant is condensed in one or more condensers or coolers 539 (e.g. seawater or air cooled) and is collected in a first refrigerant surge tank 540 from which it is cascaded through the heat exchangers (propane chillers) 513, 514, 515, 516, 526, 527, 528, 529 where the first refrigerant evaporates to cool both the feed gas and the second refrigerant, respectively. Gas turbine 538 may comprise air inlet systems that in turn may comprise air filtration devices, moisture separation devices, chilling and/or heating devices or particulate separation devices.

If desired, means may be provided in system 500 of FIG. 5A for cooling the inlet air 571 to gas turbine 538 for improving the operating efficiency of the turbine. Basically, the system may use excess refrigeration available in system 500 to cool an intermediate fluid, which may comprise water, glycol or another heat transfer fluid, that, in turn, is circulated through a closed, inlet coolant loop 550 to cool the inlet air to the turbines.

Referring to FIG. 6, to provide the necessary cooling for the inlet air 571, a slip-stream of the first refrigerant is withdrawn from the first refrigeration circuit 520 (i.e. from surge tank 540) through a line 551 and is flashed across an expansion valve 552. Since first refrigeration circuit 520 is already available in gas liquefaction processes of this type, there is no need to provide a new or separate source of cooling in the process, thereby substantially reducing the costs of the system. The expanded first refrigerant is passed from expansion valve 552 and through a heat exchanger 553 before it is returned to first refrigeration circuit 520 through a line 554. The propane evaporates within heat exchanger 553 to thereby lower the temperature of the intermediate fluid which, in turn, is pumped through the heat exchanger 553 from a storage tank 555 by pump 556.

The cooled intermediate fluid is then pumped through air chiller or cooler 558 positioned at the inlet for turbine 538. As inlet air 571 flows into the respective turbines, it passes over coils or the like in the air chillers or coolers 558 which, in turn, cool the inlet air 571 before the air is delivered to the turbine. The warmed intermediate fluid is then returned to storage tank 555 through line 559. Preferably, the inlet air 571 will be cooled to no lower than about 5° Celsius (41° Fahrenheit) since ice may form at lower temperatures. In some instances, it may be desirable to add an anti-freeze agent (e.g. ethylene glycol) with inhibitors to the intermediate fluid to prevent plugging, equipment damage and to control corrosion.

A wet air fin cooler 604 may be connected to the first refrigeration circuit 520. As shown in FIG. 6, wet air fin cooler 604 combines the cooling effectiveness of (a) a conventional air fin heat exchanger, which may use a fan 608 to pass ambient air over finned tubes through which pass the fluid (e.g. liquid or gas) to be cooled to near ambient temperature (e.g. dry bulb temperature), with (b) psychometric cooling by vaporizing a liquid, typically water, within the ambient air stream using, for example, nozzles 610 in a spray header 612, to approach the lower wet bulb temperature of the ambient air.

Wet air fin cooler 604 is used to sub-cool the slip-stream of liquid first refrigerant in line 551 from surge tank 540. The sub-cooled first refrigerant is directed through line 605 to heat exchanger 553. Sub-cooling this propane increases both the refrigeration duty of heat exchanger 553 and the coefficient of performance of the refrigeration system. This coefficient of performance is the ratio of the refrigeration duty of the heat exchanger 553 divided by the incremental compressor power to provide that refrigeration. The wet air fin cooler 604 is positioned to cool the slip-stream of first refrigerant in line 551 in FIGS. 5A and 6. Alternatively, the wet air fin cooler 604 could be incorporated as part of the one or more condensers or coolers 539 to sub-cool liquid propane that serves the other parts of the liquefaction process before the slip-stream of first refrigerant in line 551 is removed to provide a source of cooling (direct or indirect) to air chiller or cooler 558. However, it is preferred to sub-cool only the slip-stream of propane in line 551 to maximize the benefit with respect to gas turbine inlet air chilling.

According to disclosed aspects, separator 601 is positioned in the gas turbine air inlet following the air chiller or cooler 558. This separator 601 removes the water that is condensed from the inlet air 571 as the inlet air is cooled from its ambient dry bulb temperature to a temperature below its wet bulb temperature. Separator 601 may be of the inertial type, such as vertical vane, coalescing elements, a low velocity plenum, or a moisture separator known to those skilled in the art. The gas turbine air inlet may include filtration elements, such as air filters 541, that may be located either upstream or downstream or both up and downstream of the air chiller or cooler 558 and the separator 601, respectively. Preferably, at least one filtration element is located upstream of the chiller and separator. This air filtration element may include a moisture barrier, such as an ePTFE (expanded PTFE) membrane which may be sold under the GORETEX trademark, to remove atmospheric mist, dust, salts or other contaminants that may be concentrated in the condensed water removed by separator 601. By locating at least one filtration element or similar device upstream of the chiller and separator associated with gas turbines 538, atmospheric contaminants in the collected moisture (water) can be minimized, fouling and corrosion of the chiller(s) and separator(s) can be minimized, and fouling and corrosion of the wet air fin cooler 604 can also be controlled and minimized.

During the chilling of the gas turbine inlet air 571, a significant portion of the refrigeration duty is used to condense the moisture in the gas turbine inlet air 571 rather than simply reducing the dry bulb temperature of the inlet air. As an example, if inlet air with a dry bulb temperature of 40° Celsius and a wet bulb temperature of 24° Celsius is chilled, the effective specific heat of the air is about 1 kJ/kg/° C. between 40° C. and 24° C. but increases dramatically to about 3 kJ/kg/° C. below the wet bulb temperature of 24° C. as the dry bulb temperature is reduced and moisture is condensed from the air. From this, one could conclude that about two-thirds of the refrigeration duty used to chill the air below the wet bulb temperature (dew point) is wasted since the small compositional change of the air to the gas turbine 538 has only a small effect on the available power of the gas turbine. This condensed moisture is essentially at the same temperature as the chilled inlet air to the gas turbine and could be used to provide some precooling of the inlet air 571 using another chilling coil similar to air chillers or coolers 558 that is positioned ahead of the air chillers or coolers 558 in the air flow. However, this arrangement can only recoup the part of the refrigeration duty used to reduce the temperature of the water but not the part used to condense it. That is, the heat of vaporization of the water cannot be recouped by heat transfer or psychometric cooling with the gas turbine inlet air.

A much greater portion of the refrigeration duty used to cool and condense the moisture from the gas turbine inlet air 571 can be recouped by collecting this chilled water from separator 601, pumping the chilled water stream 510 with a pump 603 and spraying the c chilled water stream onto the tubes of the wet air fin cooler 604 or otherwise mixing the water with the air flow 606 to the wet air fin cooler 604. Based on the ambient conditions and the actual flow rate of air conveyed by the fan associated with the wet air fin cooler 604, the water pumped by pump 603 may be sufficient to saturate the air flow of wet air fin cooler 604 and bring it to its wet bulb temperature. Excess water flow from separators 601 may be available that could be used for another purpose, or may be insufficient to saturate air flow. In this later case, additional water from another source may be provided.

Figure 5B:
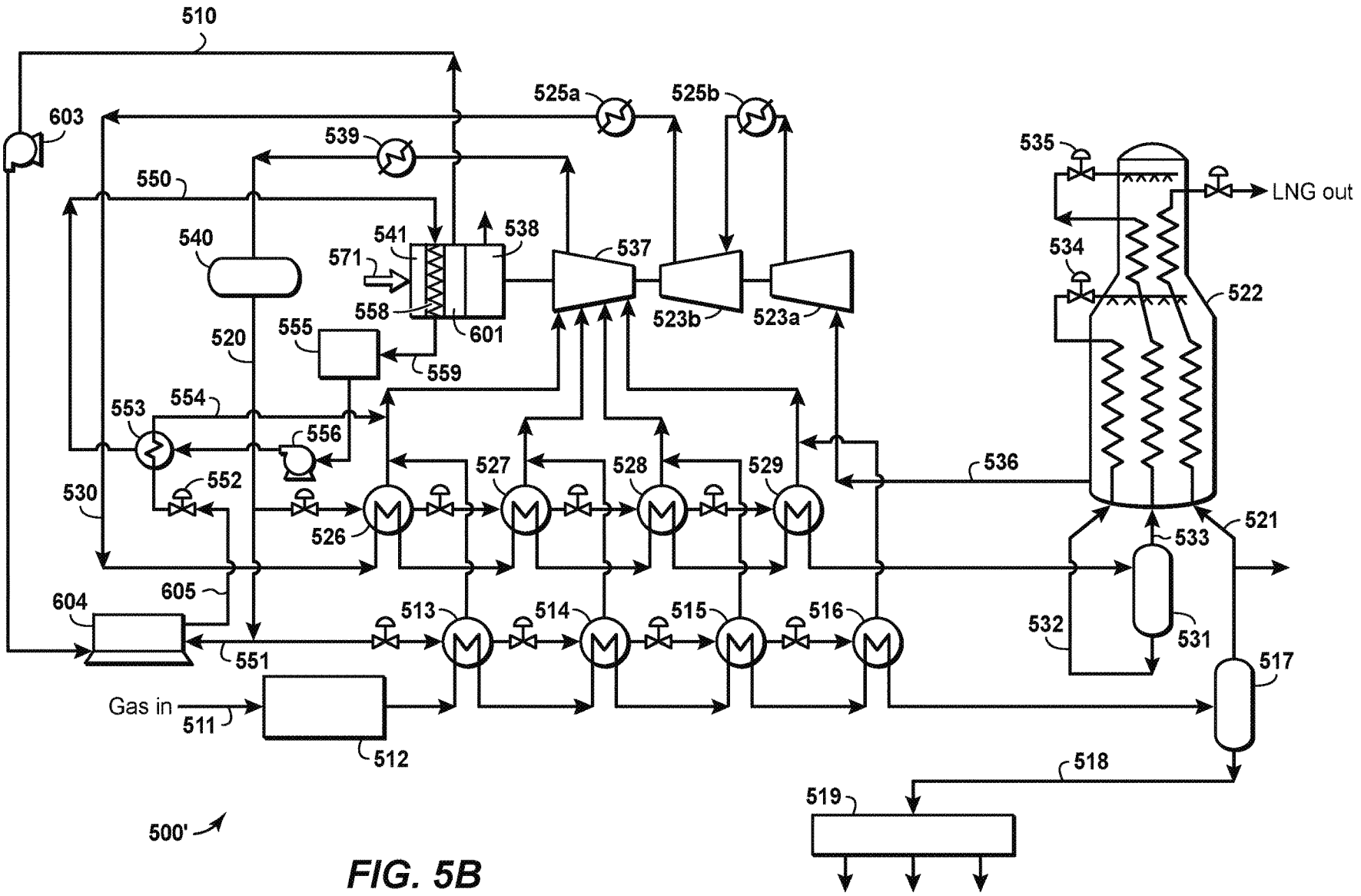

FIG. 5B shows a system 500' and process for liquefying natural gas (LNG) according to another aspect of the disclosure. System 500' is similar to system 500 of FIG. 5A, and therefore similar elements and reference numbers will not be further described. The compression duty of second refrigeration compressor 523 (shown in FIG. 7) is shared by two compressors 523*a*, 523*b*, both of which are operationally connected to and driven by the large-scale multi-shaft gas turbine 538.

Figure 7:
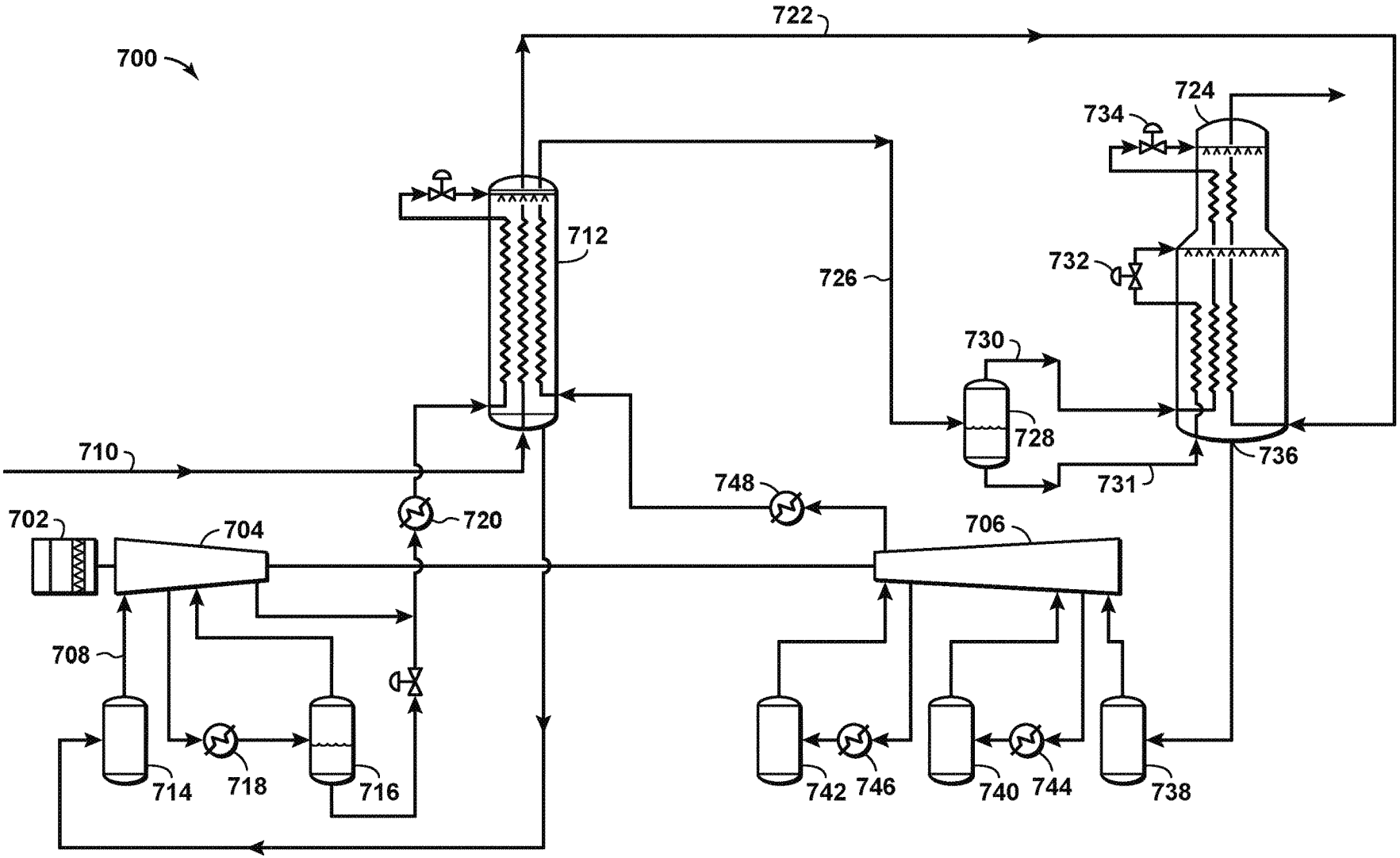
FIG. 7 is a schematic diagram of a system for liquefying natural gas according to disclosed aspects.

FIG. 7 depicts a system 700 for liquefying LNG using dual mixed refrigerants according to another aspect of the disclosure. System 700 includes a large-scale multi-shaft gas turbine 702, similar to the gas turbines previously described herein. The large-scale multi-shaft gas turbine 702 is operationally connected to a first refrigeration compressor 704 and a second refrigeration compressor 706. The first refrigeration compressor 704 may be used to compress a warm mixed refrigerant stream 708 to be used to initially cool a feed gas stream 710 in a warm liquefaction exchanger 712. After so cooling the feed gas stream, the warm mixed refrigerant stream 708 exits the bottom of the warm liquefaction exchanger and is processed and re-compressed in a series of drums 714, 716, ambient coolers 718, 720, and the first refrigerant compressor 704. The partially-cooled feed gas stream 722 exits the warm liquefaction exchanger 712 and is further cooled in a cold liquefaction exchanger 724 by exchanging heat with a cold mixed refrigerant stream 726, which has also passed through the warm liquefaction heat exchanger 712 as an additional coolant for the feed gas stream 710. In an aspect, the warm mixed refrigerant stream 708 has a different composition than the cold mixed refrigerant stream 726 to ensure progressive cooling and eventual liquefaction of the feed gas stream 511. After exiting the warm liquefaction heat exchanger 712, the cold mixed refrigerant stream 726 may then flow to a high pressure separator 728, which separates the condensed liquid portion of the cold mixed refrigerant stream from the vapor portion thereof. The condensed liquid and vapor portions of the cold mixed refrigerant stream are output from the high pressure separator 728 in lines 730 and 731, respectively. As seen in FIG. 7, both the condensed liquid and vapor from high pressure separator 728 flow through the cold liquefaction exchanger 724 where they cool the partially-cooled feed gas stream 722.

The condensed liquid stream in line 731 is removed from the middle of cold liquefaction exchanger 724 and the pressure thereof is reduced across an expansion valve 732. The now low pressure cold mixed refrigerant is then put back into the cold liquefaction exchanger 724 where it is evaporated by the warmer cold mixed refrigerant streams and the partially-cooled feed gas stream 722. When the cold mixed refrigerant vapor stream reaches the top of the cold liquefaction exchanger 724, it has condensed and is removed and expanded across an expansion valve 734 before it is returned to the cold liquefaction exchanger. As the condensed cold mixed refrigerant vapor falls within the cold liquefaction exchanger, it is evaporated by exchanging heat with the partially-cooled feed gas 722 and the high pressure cold mixed refrigerant stream 731. The falling condensed cold mixed refrigerant vapor mixes with the low pressure mixed refrigerant liquid stream within the middle of the cold liquefaction exchanger 724 and the combined stream exits the bottom of the cold liquefaction exchanger as a vapor through outlet 736 to flow to second refrigerant compressor 706. The second refrigerant compressor, as well as various drums 738, 740, 742, and ambient coolers 744, 746, 748, compresses and cools the cold mixed refrigerant stream, which is then sent to the warm liquefaction heat exchanger 712 as previously described.

Figure 8:
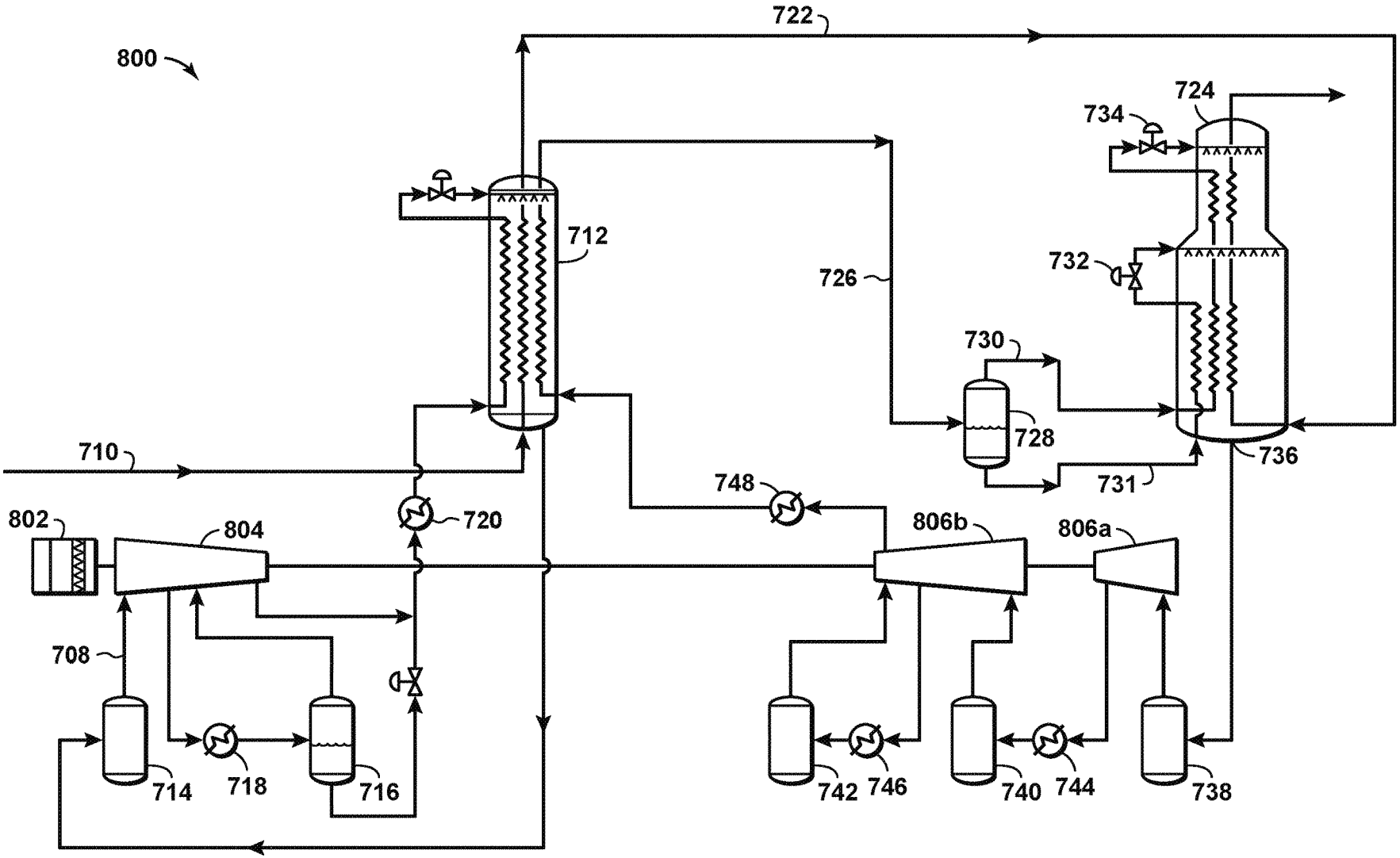
FIG. 8 is a schematic diagram of a system for liquefying, natural gas according to disclosed aspects

FIG. 8 depicts a system 800 for liquefying LNG using dual mixed refrigerants according to another aspect of the disclosure. System 800 is similar to system 700, and for the sake of brevity similar structure and reference numbers will not be further described. System 800 includes a large-scale multi-shaft turbine 802 is operationally connected to a warm mixed refrigerant compressor 804, a high pressure cold mixed refrigerant compressor 806*b*, and a low pressure mixed refrigerant compressor 806*a*. The high pressure cold mixed refrigerant compressor 806*b* and the low pressure mixed refrigerant compressor 806*a* share the compressor duty required to cool and compress the cold mixed refrigerant.

Figure 9:
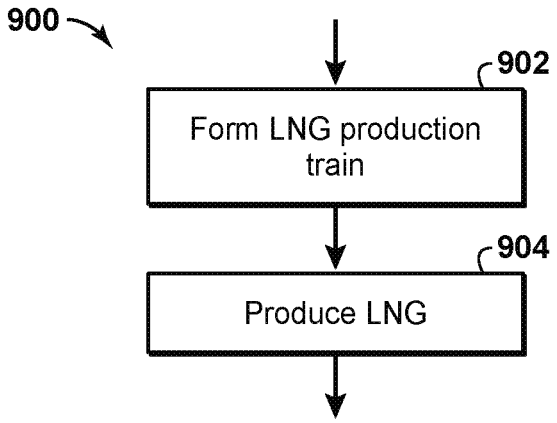
FIG. 9 is a flowchart of a method according to disclosed aspects.

FIG. 9 is a method 900 of producing liquefied natural gas (LNG) according to aspects of the disclosure. At block 902 an LNG production train is formed by matching a standardized single compression string, as described herein, to a standardized refrigerant heat exchanger system and to a standardized heat rejection system. At block 904 LNG is produced using the standardized single compression string, where the standardized refrigerant heat exchanger system and standardized heat rejection system are designed for a generic range of feed gas composition, ambient temperature and other site conditions and are installed in opportunistic locations and facilities without substantial reengineering and modifications.

The disclosed aspects provide a method of producing LNG using one or more standardized compression strings and standardized refrigerators designed for a generic range of feed gas composition, ambient temperature and other site conditions and installed in opportunistic locations and facilities without substantial reengineering or modifications, to capture D1BM ("Design 1 Build Many") cost and schedule efficiencies by allowing for broader variability in liquefaction efficiency with location and feed gas composition.

An advantage of the disclosed aspects is reduced and paced capital expense for a large-scale LNG train developed incrementally from standardized building blocks. For example, it is possible to achieve a combined output above 7 MTA that is developed from three to four sets of identical standardized equipment and bulk components. Another advantage is that this approach enables expedited schedules through use of standardized components. Still another advantage is that the LNG train may be coupled with other technologies (such as inlet air cooling or exhaust heat recovery) to improve efficiencies of the LNG train.

Aspects of the disclosure may include any combinations of the methods and systems shown in the following numbered paragraphs. This is not to be considered a complete listing of all possible aspects, as any number of variations can be envisioned from the description above.

1. A drive system for liquefied natural gas (LNG) refrigeration compressors in a LNG production train, comprising:
   a standardized single compression string consisting of
   a multi-shaft gas turbine with an output shaft operating a speed below 4,000 rpm, and no more than three standardized compressor bodies, each of the compressor bodies being applied to one or more refrigeration compressors employed in one or more refrigerant cycles;

wherein the standardized single compression string is designed for a generic range of feed gas composition, ambient temperature and other site conditions.

2. The drive system of claim 1, wherein the drive system is installed in opportunistic locations and facilities without substantial reengineering or modifications to capture D1BM ("Design 1 Build Many") cost and schedule efficiencies by allowing for broader variability in liquefaction efficiency with location and feed gas composition.

3. The drive system of paragraph 1, wherein the multi-shaft gas turbine uses its inherent speed turndown range to:

start the one or more refrigeration compressors from rest, bring the one or more refrigeration compressors up to an operating rotational speed, and adjust compressor operating points to maximize efficiency of the one or more refrigeration compressors or efficiency of the LNG production train, without assistance from electrical motors or variable frequency drives.

4. The drive system of paragraph 1, wherein the drive system has no gear box.

5. The drive system of paragraph 1, wherein the drive system includes a starter motor having a maximum power output of 5 MW.

6. The drive system of paragraph 1, wherein the one or more refrigerant cycles include one or more of a single mixed refrigerant cycle, a propane precooled mixed refrigerant cycle, and a dual mixed refrigerant cycle.

7. The drive system of paragraph 1, wherein the standardized single compression string is a first standardized single compression string, and further comprising one or more additional standardized single compression strings identical to the first standardized single compression string.

8. The drive system of any of paragraphs 1-7, further comprising a waste heat recovery unit that extracts heat from exhaust gases of the multi-shaft gas turbine, thereby increasing overall energy efficiency of the LNG production train.

9. The drive system of any of paragraphs 1-8, further comprising an inlet air chilling apparatus configured to chill air entering an inlet of the multi-shaft gas turbine, thereby maximizing natural gas throughput and/or efficiency of the LNG production train.

10. The drive system of paragraph 9, wherein the inlet air chilling apparatus comprises a mechanical refrigeration system that is independent of the standardized single compression string.

11. The drive system of paragraph 10, wherein the inlet air chilling apparatus comprises a mechanical refrigeration system that is integrated with the standardized single compression string, wherein the air entering the inlet of the multi-shaft gas turbine is chilled using refrigerant compressed by one or more of the refrigeration compressors of the standardized single compression string.

12. The drive system of any one of paragraphs 1-11, wherein the multi-shaft gas turbine comprises a large scale multi-shaft gas turbine having a maximum power output larger than 70 megawatts.

13. The drive system of any one of paragraphs 1-12, wherein the multi-shaft gas turbine comprises a gas turbine with a free power turbine.

14. The drive system of any one of paragraphs 1-13, wherein the refrigeration compressor is a centrifugal compressor or an axial compressor.

15. The drive system of any one of paragraphs 1-14, wherein the drive system has no helper driver.

16. A method of producing liquefied natural gas (LNG), comprising:

forming an LNG production train by matching the standardized single compression string of paragraph 1 to a standardized refrigerant heat exchanger system and to a standardized heat rejection system;

using the standardized single compression string, producing LNG where the standardized refrigerant heat exchanger system and standardized heat rejection system are designed for a generic range of feed gas composition, ambient temperature and other site conditions and are installed in opportunistic locations and facilities without substantial reengineering and modifications.

17. The method of paragraph 16, wherein producing LNG comprises producing LNG at a rate of at least 1.6 million tons per annum.

18. The method of paragraph 16, wherein the LNG production train is a first LNG production train, and further comprising forming one or more additional LNG production trains identical to the first LNG production train, to thereby produce LNG.

19. The method of paragraph 18, wherein the first LNG production train and the one or more additional LNG production trains combine to produce LNG at a rate of at least 3.2 million tons per annum.

20. The method of paragraph 16, wherein the standardized single compression string is a first standardized single compression string, and further comprising:

matching one or more additional standardized single compression strings to the standardized refrigerant heat exchanger system and to the standardized heat rejection system, to thereby produce a single LNG production train capable of producing LNG.

21. The method of paragraph 20, wherein the first standardized single compression string and the one or more additional standardized single compression strings combine to produce LNG at a rate of at least 3.2 million tons per annum.

22. The method of paragraph 16, further comprising using an inherent speed turndown range of the multi-shaft gas turbine to:

start the one or more refrigeration compressors from rest, bring the one or more refrigeration compressors up to an operating rotational speed, and adjust compressor operating points to maximize efficiency of the one or more refrigeration compressors or efficiency of the LNG production train, without assistance from electrical motors or variable frequency drives.

23. The method of any one of paragraphs 16-22, further comprising:

extracting heat from exhaust gases of the multi-shaft gas turbine, thereby increasing overall energy of the LNG production train.

24. The method of any one of paragraphs 16-23, further comprising:

chilling air entering an inlet of the multi-shaft gas turbine, thereby maximizing natural gas throughput and/or efficiency of the LNG production train.

While the present techniques can be susceptible to various modifications and alternative forms, the examples described above are non-limiting. It should again be understood that the techniques is not intended to be limited to the particular embodiments disclosed herein. Indeed, the present techniques include all alternatives, modifications, and equivalents falling within the true spirit and scope of the appended claims.

The invention claimed is:

1. A method of producing liquefied natural gas (LNG), comprising:

forming an LNG production train by matching a standardized single compression string to a refrigerant heat exchanger system and to a heat rejection system, wherein the standardized single compression string consists of a multi-shaft gas turbine with an output shaft operating a speed below 4,000 rpm, and no more than three standardized compressor bodies, each of the compressor bodies being applied to one or more refrigeration compressors employed in one or more refrigerant cycles;

wherein the standardized single compression string is designed for a range of feed gas compositions and ambient temperatures wherein the multi-shaft gas turbine comprises a large scale multi-shaft gas turbine having a maximum power output larger than 70 megawatts;

using the standardized single compression string, producing LNG where the refrigerant heat exchanger system and heat rejection system are designed for the range of feed gas compositions and ambient temperatures and are installed in locations and facilities without substantial reengineering and modifications.

2. The method of claim 1, wherein the LNG production train is a first LNG production train, and further comprising forming one or more additional LNG production trains identical to the first LNG production train, to thereby produce LNG.

3. The method of claim 1, wherein the standardized single compression string is a first standardized single compression string, and further comprising:

matching one or more additional standardized single compression strings to the refrigerant heat exchanger system and to the heat rejection system, to thereby produce a single LNG production train capable of producing LNG.

4. The method of claim 3, wherein the first standardized single compression string and the one or more additional standardized single compression strings combine to produce LNG at a rate of at least 3.2 million tons per annum.

5. The method of claim 1, further comprising using an inherent speed turndown range of the multi-shaft gas turbine to:

start the one or more refrigeration compressors from rest, bring the one or more refrigeration compressors up to an operating rotational speed, and adjust compressor operating points to maximize efficiency of the one or more refrigeration compressors or efficiency of the LNG production train, without assistance from electrical motors or variable frequency drives.

6. The method of claim 1, further comprising:

extracting heat from exhaust gases of the multi-shaft gas turbine, thereby increasing overall energy efficiency of the LNG production train.

7. The method of claim 1, further comprising: chilling air entering an inlet of the multi-shaft gas turbine, thereby maximizing natural gas throughput and/or efficiency of the LNG production train.

8. The method of claim 1, wherein the standardized single compression string has no gear box.

9. The method of claim 1, wherein the standardized single compression string includes a starter motor having a maximum power output of 5 MW.

10. The method of claim 1, wherein the one or more refrigerant cycles include one or more of a single mixed refrigerant cycle, a propane precooled mixed refrigerant cycle, and a dual mixed refrigerant cycle.

11. The method of claim 7, wherein the air is chilled using an inlet air chilling apparatus comprising a mechanical refrigeration system that is independent of the standardized single compression string.

12. The method of claim 11, wherein the air is chilled using an inlet air chilling apparatus comprising a mechanical refrigeration system that is integrated with the standardized single compression string, wherein the air entering the inlet of the multi-shaft gas turbine is chilled using refrigerant compressed by one or more of the refrigeration compressors of the standardized single compression string.

13. The method of claim 1, wherein the multi-shaft gas turbine comprises a gas turbine with a free power turbine.

14. The method of claim 1, wherein the one or more refrigeration compressors are a centrifugal compressor or an axial compressor.

15. The method of claim 1, wherein the standardized compression string has no helper driver.

* * * * *